US010004294B2

(12) United States Patent
Swegle et al.

(10) Patent No.: US 10,004,294 B2
(45) Date of Patent: Jun. 26, 2018

(54) SLIP RESISTANT SOLES AND FOOTWEAR

(71) Applicants: Jonathan Swegle, West Chester, PA (US); Salvatore P. Agati, Kennett Square, PA (US); Ann B. Lashendock, Coatesville, PA (US)

(72) Inventors: Jonathan Swegle, West Chester, PA (US); Salvatore P. Agati, Kennett Square, PA (US); Ann B. Lashendock, Coatesville, PA (US)

(73) Assignee: DANSKO, LLC, West Grove, PA (US)

( * ) Notice: Subject to any disclaimer, the term of this patent is extended or adjusted under 35 U.S.C. 154(b) by 323 days.

(21) Appl. No.: 14/547,674

(22) Filed: Nov. 19, 2014

(65) Prior Publication Data

US 2016/0000183 A1 Jan. 7, 2016

Related U.S. Application Data

(60) Provisional application No. 61/903,253, filed on Nov. 12, 2013.

(51) Int. Cl.

| | |
|---|---|
| ***A43B 13/22*** | (2006.01) |
| ***A43B 13/14*** | (2006.01) |
| ***A43B 3/00*** | (2006.01) |

(52) U.S. Cl.

CPC ..... *A43B 13/223* (2013.01); *A43B 3/0036* (2013.01); *A43B 3/0078* (2013.01); *A43B 13/14* (2013.01); *A43B 13/22* (2013.01)

(58) Field of Classification Search

CPC ..... A43B 13/223; A43B 3/0078; A43B 13/04; A43B 13/145; A43B 13/22; A43B 13/14; A43B 3/0036; A43B 5/001; A43B 13/122

(Continued)

(56) References Cited

U.S. PATENT DOCUMENTS

| | | | | |
|---|---|---|---|---|
| 4,724,624 | A | 2/1988 | Duclos | |
| D525,017 | S * | 7/2006 | Ochoa | D2/947 |

(Continued)

FOREIGN PATENT DOCUMENTS

| | | |
|---|---|---|
| CA | 1260704 A | 9/1989 |
| EP | 0367297 A2 | 5/1990 |

(Continued)

OTHER PUBLICATIONS

"Preventing Slips and Falls: Slip Resistant Footwear", Liberty Mutual, Loss Control Reference Note, LC 56407 R2, pp. 1-4, Sep. 2009.

(Continued)

*Primary Examiner* — Jameson Collier

(74) *Attorney, Agent, or Firm* — Cozen O'Connor

(57) ABSTRACT

A shoe including a slip resistant sole having a bottom face, wherein the sole includes a plurality of arcuate-shaped lugs having non-linear edges, each lug including an inner arc and an outer arc, wherein the outer arc is a convex side and the inner arc is a concave side shorter than the convex side, and each lug includes a groove transecting the lug, wherein the lugs are arranged into a pinwheel pattern group that includes three of the lugs, wherein the bottom face of the sole includes a plurality of the pinwheel pattern groups, and wherein each of the pinwheel pattern groups is radially symmetrical and bilaterally asymmetrical.

15 Claims, 5 Drawing Sheets

(58) Field of Classification Search
USPC ..... 36/59 R, 59 C, 67 A, 25 R, 32 R, 103, 36/127; D2/947, 951, 954, 957, 956, 960
See application file for complete search history.

(56) References Cited

U.S. PATENT DOCUMENTS

| | | | | |
|---|---|---|---|---|
| D534,332 | S * | 1/2007 | McClaskie | D2/947 |
| 7,310,894 | B1 * | 12/2007 | Schwarzman | A43B 5/08 36/3 A |
| D564,191 | S * | 3/2008 | Jensen | D2/953 |
| D669,256 | S * | 10/2012 | Castellon | D2/951 |
| D674,585 | S | 1/2013 | Kubis et al. | |
| D699,421 | S * | 2/2014 | McClaskie | D2/948 |
| D717,031 | S * | 11/2014 | Della Valle | D2/951 |
| D734,931 | S * | 7/2015 | McCourt | D2/951 |
| 2003/0033734 | A1 * | 2/2003 | McMullin | A43C 15/161 36/67 A |
| 2008/0229625 | A1 * | 9/2008 | Frasson | A43B 13/24 36/59 C |
| 2009/0188132 | A1 | 7/2009 | Fujikawa et al. | |
| 2011/0247237 | A1 * | 10/2011 | Jara | A43B 3/0036 36/103 |
| 2011/0252669 | A1 * | 10/2011 | Kasprzak | A43B 5/001 36/127 |
| 2013/0008059 | A1 | 1/2013 | Sum | |
| 2014/0208610 | A1 * | 7/2014 | Dirsa | A43B 13/20 36/28 |
| 2015/0096195 | A1 * | 4/2015 | Bacon | A43B 1/0072 36/87 |

FOREIGN PATENT DOCUMENTS

| | | | |
|---|---|---|---|
| EP | 0383489 | A1 | 8/1990 |
| EP | 1762151 | A1 | 3/2007 |
| EP | 2449906 | A2 | 5/2012 |
| WO | 1999022614 | A1 | 5/1999 |
| WO | 2000004802 | A1 | 2/2000 |

OTHER PUBLICATIONS

"Slip Resistance Guide—Safety, protective and occupational footwear supplied into the European market", SATRA Technology Centre.

* cited by examiner

1A

SLIP RESISTANT SOLES AND FOOTWEAR

CROSS-REFERENCE TO RELATED APPLICATION

This application claims priority to U.S. provisional application Ser. No. 61/903,253 filed Nov. 12, 2013, which is incorporated herein by reference in its entirety.

FIELD OF INVENTION

The present application is generally related to footwear and in particular soles for slip resistance and improved performance on slippery surfaces.

BACKGROUND OF THE INVENTION

In many industries, slip and fall accidents represent the highest or second highest type of workers compensation claims. Indeed, slip and fall accidents account for nearly 11 percent of all workers compensation claims as well as 13 percent of all costs related to claims. In some circumstances, it is possible to minimize accidents though rigorous cleaning and inspection protocols, through the inclusion of certain flooring surfaces, or other programs inclined to limit falls, however, the use of proper footwear can also have an impact in limiting falls. Accordingly, slip resistant shoes and soles provide a useful tool for employers and employees to help limit injuries in the workplace.

In the United States, there are no current legal standards for measuring slip resistance of footwear and manufacturers typically use the standards of non-governmental organizations such as the International Organization for Standards (ISO) and the American Society for Testing and Materials (ASTM). Some manufacturers use the Brungaber Mark II (PIAST) slip tester and utilize standards issued by organizations such as the ISO. See ISO 13287-2006 "Personal Protective Equipment-Footwear-Test Method for Slip Resistance, ISO, Geneva, Switzerland."

Regardless of what standard is used, one type of footwear may test best under certain conditions, but fail under other conditions. For example, shoes and soles designed for use on icy surfaces may not necessarily be as well suited for hard surfaces having liquid spills, or oil, or dust, among other possible materials that increases the chance for slipping. Similarly, the actual tested conditions, including temperature, humidity, and pressure, can all impact results of slip resistance.

In seeking to manufacture a slip resistant sole, it is generally recommended to maximize contact with the walkway surface by pushing or squeezing water and contaminants away from the sole at the heel strike, mid stance and toe-off phases of the gait cycle. See Shoe and Allied Trade Association (SATRA). Wilson, M., Development of SATRA Slip Test and Tread Pattern Design Guidelines, In STP 1103, *Slips, Stumbles and Falls: Pedestrian Footwear and Surfaces*, B. Everett Gray editor, ASTM International, 100 Barr Harbor Dr. W. Conshohocken, Pa. Maximizing contact with the surface provides for more surface area for friction between the shoe sole and the surface, so as to prevent falls.

Furthermore, the sole or tread material may also impact the slip resistance of the shoe or sole. Shoe manufacturers typically use styrene butadiene rubber (SBR) or nitrile-butadiene rubber (NBR), as well as a number of polyurethane materials for the sole of the footwear. The spectrum of materials includes soft to hard materials. Typically, soft materials offer improved traction but limited durability.

Harder materials, while providing for improved durability, typically have reduced traction when compared to softer materials. On icy surfaces, a different material may be appropriate, as rubber alone is often insufficient, and studded soles may be necessary for proper traction and slip resistance. See "Loss Control Reference Note: Preventing Slips and Falls: Slip Resistant Footwear," Liberty Mutual Group, LC 5407 R2, September 2009.

The prior art has attempted to provide a shoe sole having slip resistant properties, see. e.g.: EP 1762151, WO 2000004802, WO 1999022614, CA 1260704, US D674585, EP 0383489, EP 0367297, US 20130008059, EP 2449906, U.S. Pat. No. 4,724,624, and US 20090188132, yet each of designs have various limitations that preclude their use in one or more situations.

Accordingly, there is a need for an improved shoe comprising slip resistant soles.

SUMMARY OF THE INVENTION

In a first embodiment, a shoe comprising a slip resistant sole wherein said sole comprises a plurality of arcuate shaped lugs having non-linear edges and defined by a groove transecting each lug, wherein the arcuate shaped lugs are arranged into a pinwheel pattern group comprising three arcuate shaped lugs, and wherein said pinwheel pattern groups are substantially disposed on the bottom portion of the sole.

In a further embodiment, an aspect of the present disclosure is a shoe comprising a slip resistant sole having a pattern comprising: a plurality of arcuate shaped lugs, each having a narrow end and a bulbous end, wherein said narrow and wide ends are bisected by a predetermined groove, and wherein said plurality of arcuate shaped lugs are organized wherein three arcuate shaped lugs are arranged in a pinwheel pattern group wherein the bulbous ends are centrally proximate, and wherein said plurality of pinwheel pattern groups are disposed of on the bottom of said sole.

In a further embodiment, an aspect of the invention is a slip resistant sole comprising a plurality of pinwheel lug groups, wherein each said pinwheel lug group comprises three pairs of lugs; wherein each pair of lugs having an arcuate shape comprising a narrow lug section and a bulbous lug section having a groove disposed between the two lugs; and wherein said three arcuate shaped lug pairs are arranged such that said bulbous ends are centrally situated in the pinwheel lug group and the narrow ends are radially aligned away from the center creating the pinwheel shape.

DETAILED DESCRIPTION OF THE PREFERRED EMBODIMENTS

The embodiments of the invention and the various features and advantages thereto are more fully explained with references to the non-limiting embodiments and examples that are described and set forth in the following descriptions of those examples. Descriptions of well-known components and techniques may be omitted to avoid obscuring the invention. The examples used herein are intended merely to facilitate an understanding of ways in which the invention may be practiced and to further enable those skilled in the art to practice the invention. Accordingly, the examples and embodiments set forth herein should not be construed as limiting the scope of the invention, which is defined by the appended claims.

As used herein, terms such as "a," "an," and "the" include singular and plural referents unless the context clearly demands otherwise.

As used herein, the term "about" means within 10% of a stated length.

As used herein, the term "shoe" includes shoes, sandals, boots, clogs, and other items intended to be worn as footwear.

Figure 2:
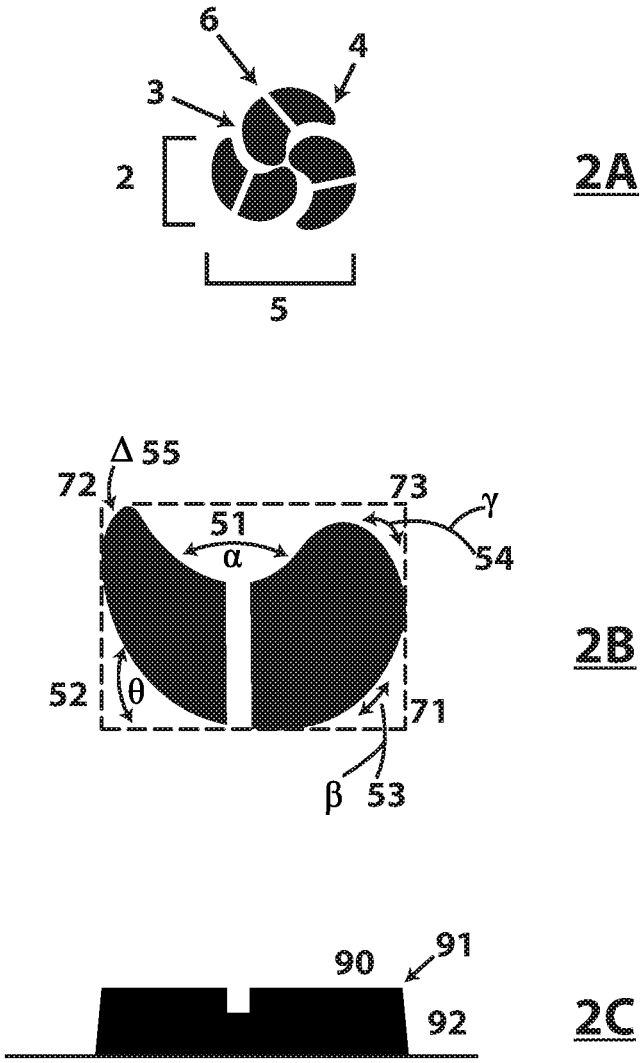
FIGS. 2A, 2B, and 2C are detailed views of embodiments of the invention described herein.

As used herein the term "arcuate lug" or "crescent lug" or "arcuate or crescent shaped member" refers to the arcuate or crescent shaped feature of numerical identifier 2, which is made up of a narrow and bulbous end as identified in FIG. 2A as features 3 and 4. The arcuate lug contains a groove (feature 6) between the bulbous and narrow ends that transects the lug. Based on the depth of the groove, the arcuate lug may be one or two pieces.

As used herein the term "pinwheel design" refers to the arrangement of the crescent lugs into a propeller like, or pinwheel like arrangement of three crescent lugs and as shown in FIG. 2A and identified by the numerical identifier 5, wherein a bulbous end is centrally aligned and the narrow ends radiate away from the center point of the pinwheel design. The pinwheel design is shaped such that each of the pinwheel pattern groups is radially symmetrical and bilaterally asymmetrical.

As used herein the term "degree of sharpness" refers to the angle between the top and side of a lug. For example, FIG. 2C identifies the top 90 and the side 92, and the degree of sharpness refers to the angle of the side 92 from the top 90. For example, in FIG. 2C the angle is about 10%, with an angle of 0% representing where the side 92 and top 90 would be perpendicular to each other.

All references cited herein are incorporated by reference in their entirety.

A primary strategy in designing slip resistant shoes is to maximize contact between the lug and the surface while expelling a material having a low coefficient of friction from the surface. In simple terms, you provide as many points of contact between the shoe and a surface, and expel any of a various number of materials that are on that surface that have a low coefficient of friction. For example, it is widely known that oil reduces friction between two surfaces.

A further aspect of slip resistance relates to the degree of sharpness of the angle (typically ranging from about 0 to about 30 degrees as measured from the vertical) of the lug. An angle of 0 degrees representing that the side of the lug (92, FIG. 2C) is perpendicular to the top (90, FIG. 2C) of the lug, and having the corner (91, FIG. 2C) of the lug being 90 degrees. Whereas an angle of 30 degrees would have a non-perpendicular lug side, and an angle of 120 degrees between the top 90 and side 92 of the lug. By increasing or decreasing such angle, the slip resistant properties of the shoes are modified wherein a sharper angle increases the slip resistant properties. Thus, an angle of 5 degrees, being sharper than 15 degree should have increased slip resistant properties. Accordingly, when creating a slip resistant shoe, the goal is to maximize friction between the lug/shoe and the surface. Where a material, such as oil is on the surface, eliminating the oil to allow for contact between the lug/shoe and the surface and not with the lug/shoe and the oil, will increase friction and thus minimize slips and falls. Accordingly, preferred embodiments utilize lugs having a degree of sharpness of about 0 to about 30 degrees or about 0 to about 15 degrees, or about 0 to about 10 degrees, or about 0 to about 5 degrees.

Surfaces are not always level and flat, and people have different walking mechanics, each of which provides for a variety of contact points between a shoe and a surface. Some people first strike the heel of the foot to the surface while walking or running, others the ball of the foot, and yet others have pronation issues either over pronation or under pronation that impacts the location of the first contact point between the shoe and the surface, as well as the points between the shoe and the surface that impart the greatest forces upon one another.

When a surface is wet with water, as one example, and a shoe is impacting upon that surface, the water will tend to be displaced away from the force. However, water has surface tension, which maintains the water in a position. Accordingly, if a flat material, for instance a flat soled sandal, impacted a flat wet (with water) floor, the water would resist dispersion from the floor upon contact by the flat soled sandal. This would retain the water under the sole and thus the flat soled sandal would be more likely to slide on the surface than if the flat soled sandal was in contact with a dry surface, thus leading to a fall.

Accordingly, it is the goal of the slip resistant shoe to move the water away from the lugs on the sole and away from the points of contact between the lugs and the surface so that the lugs may contact the surface free of water, because the surface has a higher coefficient of friction when dry than when wet, thus preventing a slip or fall.

To move the water away, it is necessary to provide for water to be able to move away from the lugs and allow for contact between the surface and the lugs. The use of designs to channel water from the lugs provides for improved contact between the lugs and the surface. The mechanism is similar for other surfaces, i.e. oily surfaces, dusty surfaces, and other surfaces that have low coefficients of friction that result in opportunities for a slip and fall. In each case, by removing or channeling the slippery materials, greater slip resistance is imparted to the sole.

Figure 1:
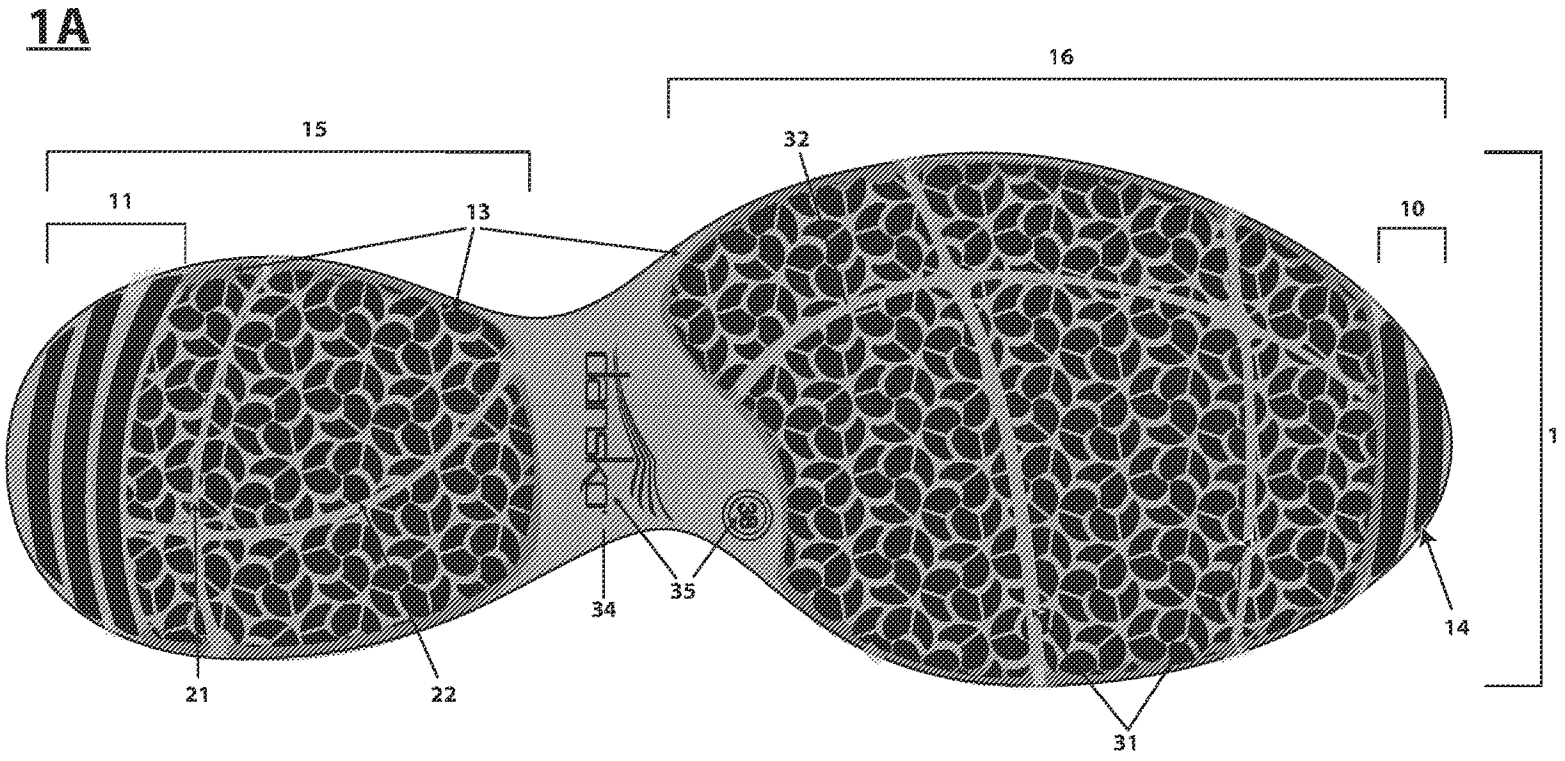
FIGS. 1A and 1B include a view from the bottom of the shoe and a side elevation view of an embodiment of the invention described herein.
Figure 1:
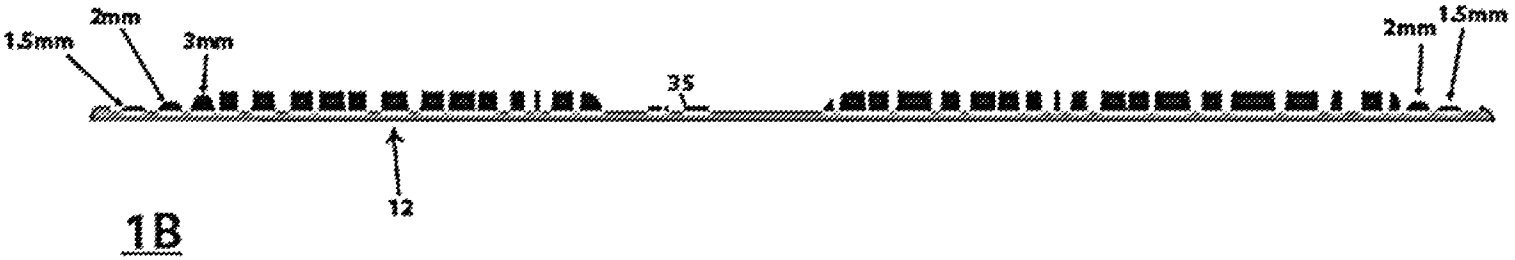

Accordingly, one embodiment of a slip resistant shoe sole is depicted by FIG. 1A, the sole 1, comprises a plurality of pinwheel lug groups 5 to create a forefoot pad 16 located on the toe 10 and a heel pad 15, located on the heel portions of the sole 1. While the general shape and nature of the pinwheel lug group 5 is maintained throughout, certain transverse and longitudinal lines may transect individual crescent lugs 2, or the pinwheel lug group 5 within the sole 1. This provides for further opportunity to divert liquids from the sole, and enhance the contact between the sole and the surface.

FIG. 1A further depicts edge lugs 13, which are situated around the circumference of each of the forefoot pad 16 and heel pad 15 sections of the sole 1. The edge lugs 13 are radiused, wherein the edges of the edge lugs 13 are rounded. The radiused edges provide that the rounding extends from about 1.5 mm from the base of the lug and about 1.5 mm as well as from the edge of the lug. The thereby the rounded edge creates an arc between the two point, thus reducing the height of the edge lugs 13 and providing the rounded edge. The edge lugs 13 are at a reduced height to allow for water to expel away from the forefoot pad 16 and heel pad 15 sections of the sole 1 and aid in providing contact between the sole 1 and the surface.

Additionally situated on the toe 10 and heel 11 portions of the sole 1, are lateral lugs 14 that stretch the width of the sole 1. Being at the tail ends of the heel 11 and the tip of the toe 10, the width is smaller than at the widest portion of the sole 1. The lateral lugs 14, at the heel 11 portion of the sole 1, are often first in contact with a surface, and the lateral lugs 14 act to dispel, squeeze, or push liquids or other contaminants away from the surface. The lateral lugs 14 are progressively taller in height (as can be seen in FIG. 1B), from the rear edge of the heel towards the arch 34 of the sole 1. The outermost lateral lug 14 on both the heel 11 and toe 10 portion is about 1.5 mm in length. The next lateral lug 14 closer to the arch of the sole 1 is about 2 mm, and, on the heel 11 portion, the third lateral lug 14 is about 3 mm. Around the perimeter of the sole 1, the lugs are recessed about 3 mm from the edge.

Further provided on the sole 1 are transverse (21 and 31) and longitudinal lines (22 and 32) that run through both the heel portion 21 and 22, and through the toe portion 31 and 32. These lines are cut through the otherwise regular and organized pattern of the pinwheel lug group 5, and provide channels for fluids or other material to be dispelled away from the lugs.

In view of FIG. 1B, a side profile is shown of the sole 1. The side profile provides for a detailed view of the height of the lugs and a viewpoint on the location of the heel pad 15 and the forefoot pad 16. Further depicted are the lateral lugs 14 at the heel 11 and the toe 10, with a space where no lugs are present at the arch 34 section. Present in the arch 34 section is raised lettering 35, a small section providing for use of trade names, sizing, and/or other identification on a shoe. In particular, the height of the lugs is shown, with the heel end and toe front having reduced height lugs as compared to the rest of the shoe. The inner face 12 of the sole is also depicted.

The height of the lugs depends on the particular use of the shoe, or boot. Lateral lugs 14 may have a height of about 0.5 mm to about 10 mm. Whereas the lugs on the forefoot pad 16 and heel pad 15 also have a height of about 0.5 mm to about 10 mm. The height of each of the lugs is the same in some embodiments. However, in other embodiments, the lugs vary in height, wherein the side or edges vary in height. Further embodiments have lugs that vary in height within a pinwheel lug group 5. Further depicted is that the base of each lug is wider than the top of each lug, thus creating a slight angle from the base of each lug to the top of each lug, and wherein the top of each lug on the forefoot pad 16 and the heel pad 15 has a generally pointed, not rounded corners. In certain embodiments, some lugs are rounded and do not have a sharp corner. For example the edge lugs 13 or lugs positioned near transverse or longitudinal lines.

Turing to a further description of an embodiment of the invention in view of FIG. 2A, the sole 1, comprises a plurality of pinwheel lug groups 5 molded to the sole 1. The pinwheel lug group 5 channels water or other contaminants on the surface away from the lugs. Each of the pinwheel lug groups 5 comprises a set of three crescent lugs 2. Each crescent lug 2 is arcuate in shape and contains three features, a bulbous end 3, a narrow end 4, and a lug groove 6, wherein the two ends are transected by the lug groove 6. The transecting lug groove 6 can encompass the entire height of the lug, or only a portion of the height. Accordingly, each crescent lug 2 may be one piece with a transecting groove, or two pieces with the transecting groove completely differentiating the narrow and bulbous components. Each of the pinwheel lug groups 5 is radially symmetrical and bilaterally asymmetrical.

Each crescent lug 2 is about 3.5 mm in height, when not at the edge of the sole, and the lug groove 6 is about 1.5 mm in width. Each of the pinwheel lug group 5 is typically the same height. In some embodiments, it is advantageous to have the height of each of the crescent lugs 2 to be slanted, such that the narrow portion is lower in height than the bulbous portion. Or, alternatively, each of the three pairs of lugs in the pinwheel lug group 5 may be of different heights.

Each of the pinwheel lug groups 5 provides for three crescent lugs 2 arranged so that the bulbous end 3 of each of the three crescent lugs 2 is centrally aligned in the pinwheel shape, and the narrow ends 4, being aligned with the outer portions of the pinwheel shape. The shape provides for the ability of a liquid to be pressed around each of the crescent lugs 2, and to be expelled either around the crescent lug 2 or through the lug groove 6. In addition, the degree of sharpness of the profile of the lug further enhances the ability of a liquid to be pressed around each of the crescent lugs 2 and to be expelled either around the crescent lug 2 or through the lug groove 6. The nature of the design allows for channeling of water or other contaminant around the crescent lug 2 to provide for greater contact with the surface and less with the water or other contaminant on the surface.

Accordingly, as depicted, the crescent lugs in FIG. 2A make up a pinwheel lug group 5. The pinwheel lug group 5 is a set of six lugs having non-linear edges and converged in a circular pinwheel or propeller type pattern, wherein there are three pairs of lugs made up of a crescent shaped end 4 and a bulbous end 3. There being disposed between each pair, a predetermined space, which is the lug groove 6. Furthermore, the three pairs are aligned in a predetermined shape defining a pinwheel or propeller like shape, wherein the bulbous ends 4 are centrally aligned and the crescent shaped end 4 is aligned on the circumference of the circular pinwheel shape. In particular, the inner length, as defined by length $\alpha$ 51 (FIG. 2B), is positioned such that it partially surrounds the bulbous end 3 of another lug pair. Each of the inner lengths being positioned to have a bulbous end 3 so situated provides for the centrally aligned bulbous ends 3.

FIG. 2B provides further detail of a crescent lug 2, wherein the particular nature of the angles and curvature of the lug is detailed. In particular, length $\alpha$ 51, defines the length between the inside portion of the crescent lug 2. In contrast, length $\theta$ 52 defines the length between the narrow end 4, and the horizontal 71. On the bulbous end 3, the length $\beta$ 53 defines the length between the bulbous end 3 and the horizontal 71. Also defined are lengths $\Delta$ 55 and the vertical 72 on the narrow end 4, and length $\gamma$ 54 and the vertical 73 on the bulbous end 3. The lengths created are representative of the curvature of the portion of the lug.

It may also be advantageous to describe the arcuate or crescent shaped lugs by visualizing the lengths of particular segments. In particular, the arc length is longer for the outer length than the inner length, wherein the inner length is defined by the length of the segment at length $\alpha$ 51 when measuring from the highest point at each of the narrow and bulbous ends, wherein the outer length is defined by the length of the segments comprising lengths of 0, 13, A, and $\gamma$ 52, 53, 54, and 55. The outer length is about 1.2 to about 8 times longer than the inner length, or about 2 to about 5 times longer than the inner length. Thus, the lugs have non-linear edges and defined by a groove 6 in each lug, wherein the crescent shaped lugs 2 are arranged into a pinwheel pattern group 5 comprising three crescent shaped lugs, and wherein said pinwheel lugs. In some embodiments the groove 6 extends from the base of the top of the lug 2 to the base of the sole. In other embodiments, the groove 6 extends to a depth of about 10% to about 90% of the height of the lug.

In a preferred embodiment, the sole 1 comprises a plurality of pinwheel lug groups 5 arranged in a regular pattern on the heel pad 15 portion of the sole 1 and on the forefoot pad 16 portion of the sole 1, but leaving a portion at arch 34 portion of the sole 1 void of pinwheel lug groups 5. In alternative embodiments, an irregular arrangement of pinwheel lug groups 5 may be featured on the sole 1.

In view of FIG. 2C, a side profile is shown of an individual lug, wherein the groove 6, extends about 40% of the height of the lug. In particular, the lug side 92 has a degree of sharpness of about 10 degrees from the vertical. Preferred degree of sharpness are about 0-30 degrees and more preferably about 0 to about 15 degrees, or about 2 to about 10 degrees. It is also advantageous that the lug corner 91, as between the lug side 92 and the top of the lug 90, has a sharp corner, and not rounded, as the sharpness of this corner and the degree of sharpness aids in slip resistance.

Figure 3:
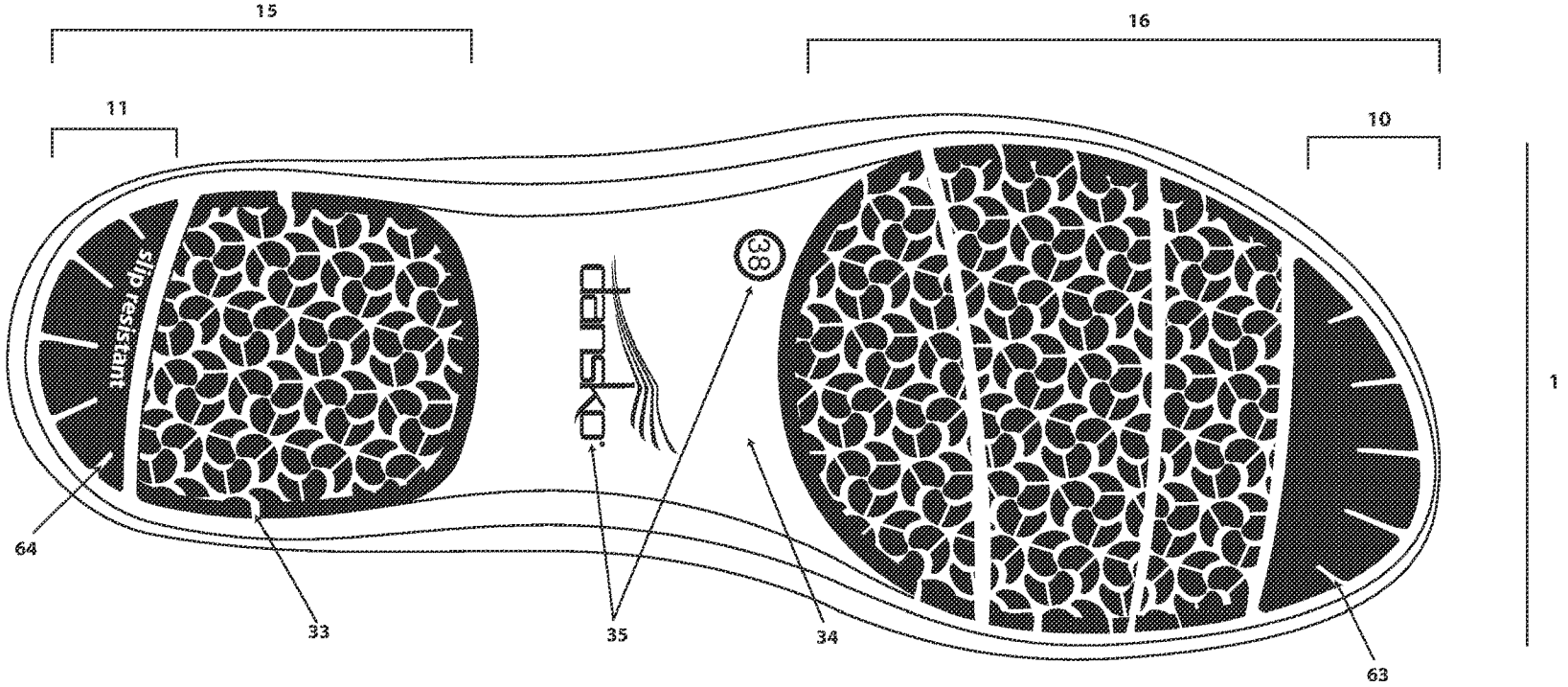
FIG. 3 is a plan view of an embodiment of the invention described herein.

For example, in view of FIG. 3, an embodiment is depicted having a heel pad 15 and a forefoot pad 16 made up a plurality of pinwheel lug groups arranged in a regular pattern. At the edge of each of the heel pad 15 and forefoot pad 16, the edges of the lug are raised at 3.0 mm. Further the rear portion of the heel 11 and the front portion of the toe 10 are void of pinwheel lug groups 5 and instead utilize a forefoot landing pad 63 and a heel landing pad 64. When walking, people frequently contact the heel first and toe off last. Accordingly, these portions both channel water through the channels located on the forefoot landing pad 63 and the heel landing pad 64, but these also serve as large durable rubber elements for improved durability of the shoe and less susceptibility to abrasion and break down, as these portions are typically the first section of a shoe to wear. Furthermore, the channels, transverse lines 21, and heel channel 33, provide areas that allow for fluids to be expelled so that fluids in the forefoot pad 16 and heel pad 15 sections may be removed from these areas.

Figure 4:
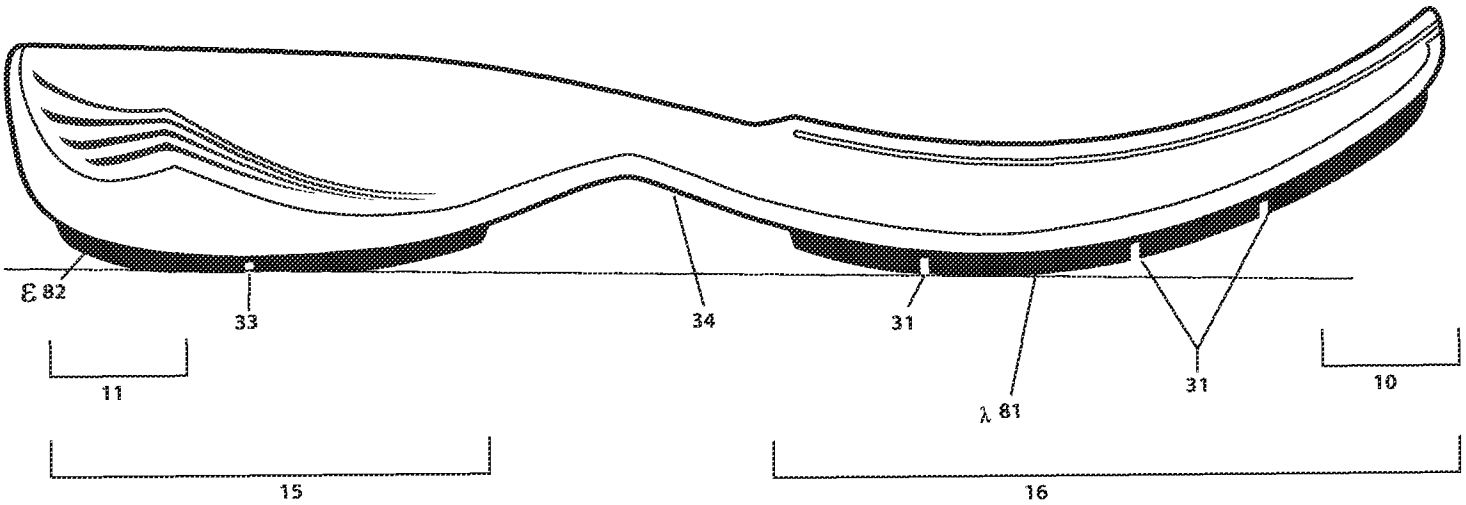
FIG. 4 is a side view of an embodiment of the invention described herein.

FIG. 4 details one embodiment of the curvature of a sole 1, having a curvature $\lambda$ 81 on the toe and a curvature of $\varepsilon$ 82 on the heel. Because of the particular curvatures, most forces of the sole are impressed upon the surface at only a small portion of the heel pad 15 and forefoot pad 16 at a given time. However, as most people roll their feet as they walk, the portion of the heel pad 15 and forefoot pad 16 imparting forces upon a surface at any given moment will change as the person continues moving. However, based on the side profile of FIG. 4, it is possible to see the raised portion of the heel pad 15 and forefoot pad 16 comprising the pinwheel lug groups 5. The length of the heel pad 15 and forefoot pad 16 depends on the size of a particular shoe.

The various embodiments detail a shoe having a slip resistant sole. Ordinary materials for a shoe sole may be utilized, including elastic polymer(s) such as synthetic rubbers, natural rubbers, ethylene-vinyl acetate copolymers, polyurethane, polyvinyl chloride. Further materials may include polybutadiene rubbers, polyisoprene rubbers, styrene-butadiene rubbers acrylonitrile butadiene rubbers, nitrile rubbers, ethylene propylene rubbers, ethylene-vinyl acetate copolymer rubber, polyamide rubbers, polyether, polyester, polyurethane, polyuria-urethane, epichlorohydrin, silicon and polysulfide rubbers. polyurea-urethane Other suitable materials may further include leather, plastic and plastic polymers, as well as natural materials such as cotton, wool, or other similar material, wood, and other fibrous materials. The sole may be secured to a midsole or other innersole or upper portion of a shoe directly, as is known to one of ordinary skill in the art. The sole may be manufactured as a single piece, wherein the lugs and the sole are either cast of manufactured in one piece, or manufactured in two or more pieces and/or steps wherein the materials for each piece may be the same or different.

In some embodiments it is advantageous to utilize different materials for lugs in certain positions on the sole, so that some of the lugs are made of a softer material, or a material that has a greater friction coefficient on a particular surface. However, there is a balance between use of soft material and hard materials in their wear and abrasion patterns that affect the useful life expectancy of a shoe. Furthermore, the density and DIN of a sole material affect the speed at which the material breaks down, but also impact the material's slip resistance. Finding an appropriate balance depends on the particular situation and it may be necessary, in some cases, to substitute a longer useful life expectancy for a shoe having greater slip resistance.

In some embodiments a pinwheel lug group 5 is replaceable on the bottom of a sole, such that pinwheel lug group 5 is interchangeable based on the particular nature of the surface to be encountered. Accordingly, an embodiment of the invention is a slip resistant shoe kit comprising a plurality of pinwheel lug groups 5 that may be inserted onto the shoe based on the needs of a user, in a similar manner as to how golf spikes or other cleats are replaced on some athletic shoes. The pinwheel lug groups are easily replaced with tools known in the art and as used with the golf spikes or other cleats.

Shoes utilizing the slip resistant pinwheel lug groups 5 may be incorporated into a portion of a sole of a shoe, or cover the entire sole of the shoe. Lugs are substantially disposed on the toe and heel portions of the sole and optionally on the arch portion of the sole. Where traction may be appropriate on the toe, heel, or sides of a sole, pinwheel lug groups 5 may be further incorporated so as to "wrap" the sole around the edge of the outsole. This provides that the pinwheel lug groups 5 may be on the side of the shoe, about or perpendicular to the pinwheel lugs on the bottom of the sole. For example, climbing shoes may require slip resistance treat on surfaces other than the bottom of the sole.

Example 1

A test was performed comparing shoes utilizing the resistant sole as described herein compared to other shoes. Each of the shoes are compared against walking shoe and occupational shoe standards, which are listed as the intended minimum for slip resistance for these types of shoes. Shoes A, B, and C, do not use the sole of the invention described herein, whereas Test Shoe A, and Test Shoe B, both utilize the pinwheel lug group feature as described herein. The chart below identifies hardness, density, and DIN (measurement of how fast the sole will abrade) of the sole material. Also quantified is slip resistance on dry, wet and oily/wet surfaces (wet+7 drops of oil), wherein a higher number is increased slip resistance.

The tests were tested under the Mark II testing method corresponding to a minimum standard for walking shoes of a Coefficient of Friction (CoF) of 0.5 Dry, 0.5 wet, and 0.4 oily/wet. Whereas the standard for Occupational shoes using the Mark II standard is 0.7 for dry surfaces, 0.6 for wet, and 0.45 for oily/wet surfaces.

TABLE 1

| | Hardness | Density | DIN | Dry-CoF | Wet-CoF | Oily/Wet CoF |
|---|---|---|---|---|---|---|
| Walking Shoe Standard | NA | NA | NA | .5 | .5 | .4 |
| Occupational Shoe Standard | NA | NA | NA | .7 | .6 | .45 |
| Shoe A | 63 Shore A | 1.13 g/cm$^3$ | 121.2 mm$^3$ | .8 | .6 | .31 |
| Shoe B | 57 Shore A | 1.23 g/cm$^3$ | 147.7 mm$^3$ | .78 | .7 | .51 |
| Shoe C | 55 Shore A | 1.13 g/cm$^3$ | 113.0 mm$^3$ | .87 | .49 | .15 |
| Test Shoe A | 57 Shore A | 1.18 g/cm$^3$ | 107.4 mm$^3$ | .88 | .63 | .48 |
| Test Shoe B | 57 Shore A | 1.20 g/cm$^3$ | 109.2 mm$^3$ | .76 | .6 | .48 |

The test shows that both Test Shoe A and Test Shoe B performed at or better than the standards for occupational shoes. However, the results for the other three shoes tested demonstrate that, only shoe B (having a higher density material and the highest DIN of the shoes tested) met all three standards. Accordingly, a shoe having a hardness of 57 Shore A or less, a density of 1.20 g/cm$^3$ or less and a DIN of 110.0 mm$^3$ or less and at least a slip resistance CoF of 0.75 on a dry surface, 0.6 on a wet surface, and 0.48 on an oily wet surface is preferred. Such a shoe provides comfort, durability, but also slip resistance.

The invention now being fully described, it will be apparent to one of ordinary skill in the art that many changes and modifications can be made thereto without departing from the spirit or scope of the appended claims.

What is claimed is:

1. A shoe comprising:

a slip resistant sole having a bottom face, wherein said sole comprises a plurality of arcuate-shaped lugs having non-linear edges, each lug comprising an inner arc and an outer arc;

wherein the outer arc is a convex side and the inner arc is a concave side shorter than the convex side;

wherein each lug includes a groove transecting the lug;

wherein the lugs are arranged into a pinwheel pattern group that comprises three of the lugs, wherein the bottom face of said sole comprises a plurality of the pinwheel pattern groups; and wherein each of the pinwheel pattern groups is radially symmetrical and bilaterally asymmetrical.

2. The shoe of claim 1, wherein each lug comprises a narrow end and a bulbous end, wherein the bulbous end is centrally aligned with the inner arc of another one of the lugs in the respective pinwheel pattern group, so as to define a pinwheel shape for the pinwheel pattern group.

3. The shoe of claim 1, wherein said plurality of pinwheel pattern groups are disposed on each of a toe portion of the shoe and a heel portion of the shoe.

4. The shoe of claim 1, wherein the groove in each lug extends to the bottom face of the sole, such that the lug comprises two parts, the two parts including a narrow part and a bulbous part separated from one another by the groove.

5. The shoe of claim 1, wherein the groove in each lug extends 9-99% of a height of the respective lug.

6. The shoe of claim 1, wherein said plurality of lugs are manufactured from one of the following materials: synthetic rubbers, natural rubbers, ethylene-vinyl acetate copolymers, polyurethane, polyvinyl chloride, polybutadiene rubbers, polyisoprene rubbers, styrene-butadiene rubbers acrylonitrile butadiene rubbers, nitrile rubbers, ethylene propylene rubbers, ethylene-vinyl acetate copolymer rubber, polyamide rubbers, polyether, polyester, polyurea-urethane, epichlorohydrin, silicon and polysulfide rubbers, or combinations thereof.

7. The shoe of claim 1, wherein said plurality of lugs have a hardness of 57 Shore A or less.

8. The shoe of claim 1, wherein said plurality of lugs have a density of 1.20 g/cm$^3$ or less.

9. A shoe comprising:

a slip resistant sole, the sole having a bottom, the bottom having a pattern comprising:

a plurality of arcuate-shaped lugs, each lug having a narrow end and a bulbous end, wherein said narrow end and said bulbous end are separated from one another by a groove, and each lug comprises an inner arc and an outer arc;

wherein the outer arc is a convex side and the inner arc is a concave side shorter than the convex side;

wherein said plurality of lugs are organized such that three of the lugs are arranged in a pinwheel pattern group, wherein the bulbous ends are proximate to a center of the pinwheel pattern group;

wherein a plurality of the pinwheel pattern groups are disposed on the bottom of said sole; and wherein each of the pinwheel pattern groups is radially symmetrical and bilaterally asymmetrical.

10. The shoe of claim 9, wherein said plurality of lugs are manufactured from one of the following materials: synthetic rubbers, natural rubbers, ethylene-vinyl acetate copolymers, polyurethane, polyvinyl chloride, polybutadiene rubbers, polyisoprene rubbers, styrene-butadiene rubbers acrylonitrile butadiene rubbers, nitrile rubbers, ethylene propylene rubbers, ethylene-vinyl acetate copolymer rubber, polyamide rubbers, polyether, polyester, polyurea-urethane, epichlorohydrin, silicon and polysulfide rubbers, or combinations thereof.

11. The shoe of claim 9 wherein the plurality of lugs have a hardness of 57 Shore A or less and a density of 1.20 g/cm$^3$ or less.

12. A slip resistant sole comprising:

a plurality of pinwheel lug groups, wherein each of said pinwheel lug groups comprises three pairs of arcuate-shaped lugs;

wherein each of the pairs of lugs has an arcuate shape comprising an inner arc and an outer arc;

wherein the outer arc is a convex side and the inner arc is a concave side shorter than the convex side, and each of the pairs of lugs comprises a narrow lug and a bulbous lug having a groove disposed between the narrow lug and the bulbous lug and each of the lugs has a degree of sharpness of between 0-33 degrees;

wherein said three lug pairs are arranged such that said bulbous lugs are centrally situated in the respective pinwheel lug group and the narrow lugs are radially aligned away from a center of the respective pinwheel lug group, thereby defining a pinwheel shape for the pinwheel lug group; and wherein each of the pinwheel lug groups is radially symmetrical and bilaterally asymmetrical.

13. The slip resistant sole of claim 12, wherein said plurality of pinwheel lug groups are arranged in a repeating manner on said sole.

14. The slip resistant sole of claim 12, wherein said degree of sharpness is between 0-16.5 degrees.

15. The slip resistant sole of claim 12, wherein said plurality of lugs have a hardness of 57 Shore A or less and a density of 1.20 $g/cm^3$ or less.

* * * * *